United States Patent [19]

Cosme

[11] 4,389,079

[45] Jun. 21, 1983

[54] DRAWER SLIDE ASSEMBLY

[76] Inventor: Peter A. Cosme, R.R. 1, Box 119, Lockport, Ill. 60441

[21] Appl. No.: 217,802

[22] Filed: Dec. 18, 1980

[51] Int. Cl.[3] ..... A47B 88/04; F16C 29/00

[52] U.S. Cl. ..... 312/330 R; 312/343; 312/344; 312/347; 308/3.6

[58] Field of Search ..... 312/338, 330 R, 330 SM, 312/347, 345, 344, 343, 350, 341 NR, 341 R; 308/3.6; 211/162

[56] References Cited

U.S. PATENT DOCUMENTS

| | | | |
|---|---|---|---|
| 475,230 | 5/1892 | Bumdick | 312/343 |
| 1,453,546 | 5/1923 | Cook | 308/3.6 |
| 3,281,198 | 10/1966 | Anderson et al. | 312/344 |
| 3,363,960 | 1/1968 | Reiss et al. | 312/344 |
| 3,482,888 | 12/1969 | Anderson | 312/343 |
| 3,702,717 | 11/1972 | Gutner | 312/347 |
| 3,825,310 | 7/1974 | Roemer | 312/330 R |
| 3,850,482 | 11/1974 | Gutner | 308/3.6 |
| 3,926,492 | 12/1975 | Gutner | 308/3.6 |
| 3,981,553 | 9/1976 | Gutner | 312/344 |
| 4,305,625 | 12/1981 | Gutner et al. | 312/330 R |

FOREIGN PATENT DOCUMENTS

| | | | |
|---|---|---|---|
| 941817 | 11/1963 | United Kingdom | 312/330 R |

*Primary Examiner*—Victor N. Sakran

*Attorney, Agent, or Firm*—Frank H. Marks

[57] ABSTRACT

Cabinet furniture wherein the principal element of novelty is a new and improved drawer slide, applicable to a wide variety of case goods such as chests, desks, dressers, tables and other household furniture having a drawer. While especially designed for furniture constructed mainly of wood or like material, my invention is also applicable to cases of metal, etc. My improved slide comprises a pair of interengaging male and female channel like members which may conveniently be metal stampings, one affixed to an upper surface of a drawer cavity while the other is attached to the drawer bottom and designed to ride in the first mentioned channel member. One of said channels, preferably though not necessarily that attached to the drawer bottom, has affixed to its leading or rear end a slide or guide block preferably molded of synthetic plastic having a low friction coefficient, serving to introduce the channel by which it is carried into the other channel and also serving as a low friction bearing for smooth sliding movement of the drawer. My invention is characterized by low cost, exceptionally smooth sliding operation and a complete absence of movable elements such as ball or roller bearings, which have been employed in previous structures of this nature with major inherent disadvantages.

7 Claims, 7 Drawing Figures

DRAWER SLIDE ASSEMBLY

My invention relates to household furniture of the class known in the trade as case goods, and has to do more particularly with drawer construction and especially to that part of the structure known as slides interconnecting a drawer and cavity of the case. While especially applicable to furniture formed principally or in part of wood or the like, it also may be found useful in metal or other kinds of furniture.

A major problem in the construction of case goods is the interfitting of drawers and cavities in such manner that the drawers will slide with a minimum of friction, wobble, wedging, etc., and maintain such easy action for the life of the piece.

BACKGROUND

From my long studies in this field, I am well aware that numerous attempts have been made to provide slides to facilitate drawer movement, some of which have found their way to the market. Those with which I am familiar have radical disadvantages.

Inasmuch as elimination of friction is a prime objective, movable anti-friction devices have been provided such as ball or roller bearings. They have proven quite unsatisfactory for a number of reasons. For example, such bearing elements, being loose, tend to fall out and be lost in the course of shipment or movement of the piece. Furthermore, lubricant has been found desirable or necessary, which tends to dry out in time, becoming gummy and resulting in sticking and jamming of the drawer.

Furthermore, drawer slides of the prior art with which I am familiar are costly enough to discourage their use.

BRIEF OUTLINE OF INVENTION

An object of my invention is to provide, in case goods, drawer mountings comprising new and improved slides which avoid the disadvantages of the aforesaid prior art with which I am familiar. Slides embodying my invention avoid the use of movable parts such as bearings with their attendant disadvantages, as outlined hereabove, and are relatively inexpensive.

Essentially, my improved slide construction contemplates male and female channel members, preferably formed of metal stampings such as galvanized steel, attached respectively to the drawer bottom and cavity top, said channels being proportioned for a minimum of play and mounted in opposed relation with the web portion of each channel forming seats for mounting, as by screws or the like, on the adjacent surfaces of cavity and drawer. Of major importance in the novel combination is a guide or slide block molded of synthetic resin and secured to the leading end of one of the channels so as to provide a guiding tongue in the introduction of one channel into the other when fitting a drawer into its cavity. After such introduction, made extremely facile by said molded block, the latter serves as a bearing to insure easy sliding movement and avoiding the aforesaid disadvantages of movable bearings.

Other objects and advantages will doubtless suggest themselves to those skilled in the art as the description proceeds.

BRIEF DESCRIPTION OF DRAWINGS

Turning now to the drawings forming part of this specification and illustrating certain preferred embodiments of my invention.

DETAILED DESCRIPTION

Figure 1:
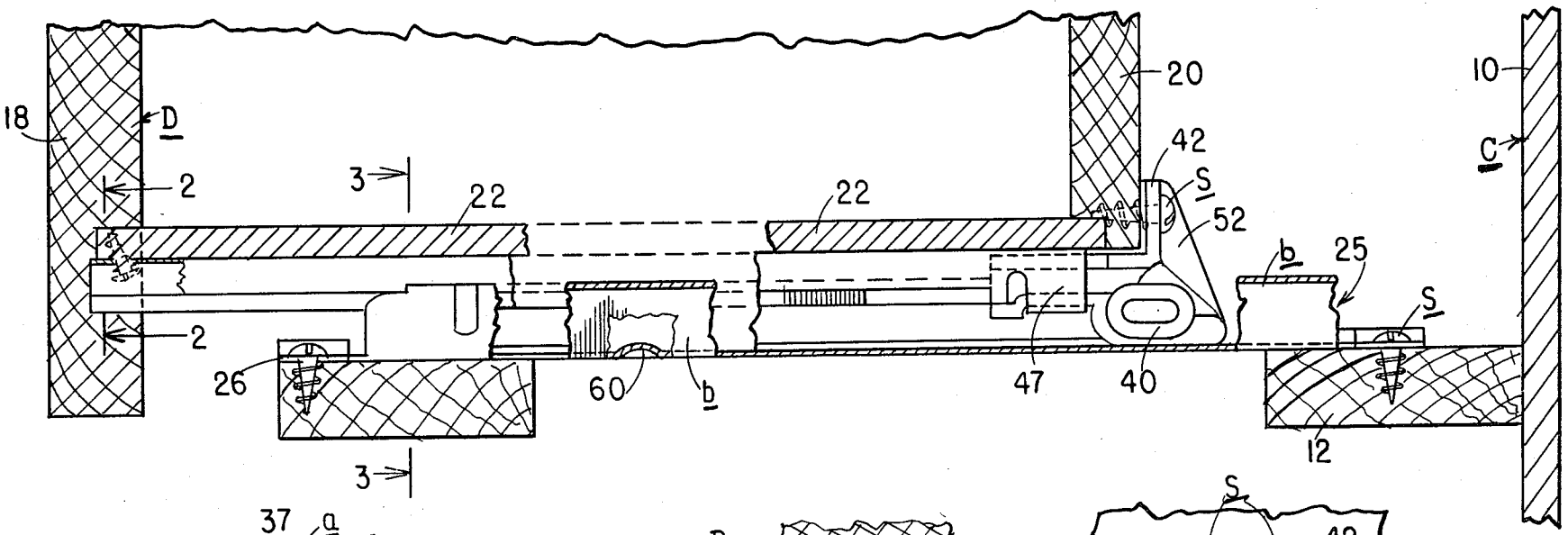
FIG. 1 is a fragmentary longitudinal view, partly in elevation and partly in section, of a drawer slide embodying my invention as applied to a drawer and cabinet, with parts broken away for added clearness.
Figure 5:
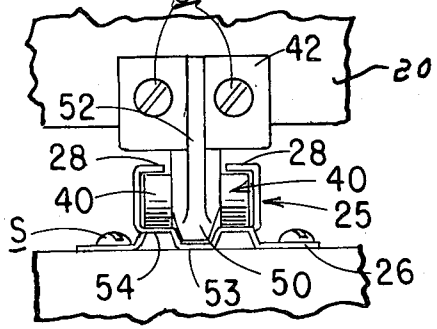
FIG. 5 is a fragmentary elevation of the case, drawer and mating slide members viewed from outside the drawer back.
Figure 3:
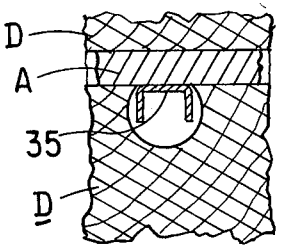
FIG. 3 is a similar view taken substantially along line 3—3 of FIG. 1.

Reference character C indicates a cabinet or case of any type, in this instance constructed mainly or entirely of wood or other suitable material, having a vertical back wall member 10, a horizontal member 12 that may be skeletal and which provides a support for a drawer indicated generally by character D.

Drawer D may be of standard or other suitable construction with a front vertical panel 18, a back vertical panel 20 and a horizontal bottom panel 22 for supporting whatever articles are to be housed in the drawer.

Secured to the top surface of support member 12 is a fixed guide member b which may be attached to the case by any suitable means such as wood screws S. In the embodiment shown I provide an integral bilateral bracket 26 with perforated ears (FIG. 2).

Guide member b is generally of channel or U-formation with opposed generally horizontal flanges 28, 28 at the top, lying in the same plane so as to form a semi-inclosed and generally rectangular cavity or nest 30 extending longitudinally of guide member b to seat a mating slide member a on the drawer, about to be described. Both members a and b may be formed as stampings of galvanized steel or the like.

Slide a is attached to the bottom of drawer D (FIG. 1) as by wood screws S. It should not be necessary to point out that the attachment means, such as screws, is a matter of choice open to the individual craftsman and susceptible of wide variation.

Figure 2:
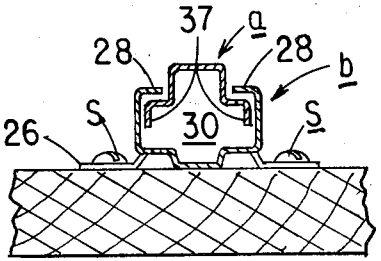
FIG. 2 is a fragmentary transverse sectional view taken substantially along line 2—2 of FIG. 1.

As seen in FIG. 2, slide a comprises a channel member terminating in a pair of spaced parallel, vertical flanges 37, 37. The elements of the two channel members b and a are so proportioned that part a will nest snugly within part b with only sufficient vertical and horizontal play to prevent binding or jamming without the need for lubricant; in other words, having free sliding movement.

Affixed to the rear end of drawer slide member a is a guide/slide block 40 preferably molded of a suitable synthetic plastic such as polyethylene or polypropylene. Such synthetic plastic resins and their particular anti-friction and other characteristics are well known in the art and especially with regard to their high suitability as bearings in a great variety of anti-friction relationships. Such properties are utilized in my invention, where it is highly desirable that the parts be fitted with a minimum of clearance together with a minimum of friction, with no likelihood of wobble or jamming in normal movement of the drawer back and forth in the cavity.

Figure 6:
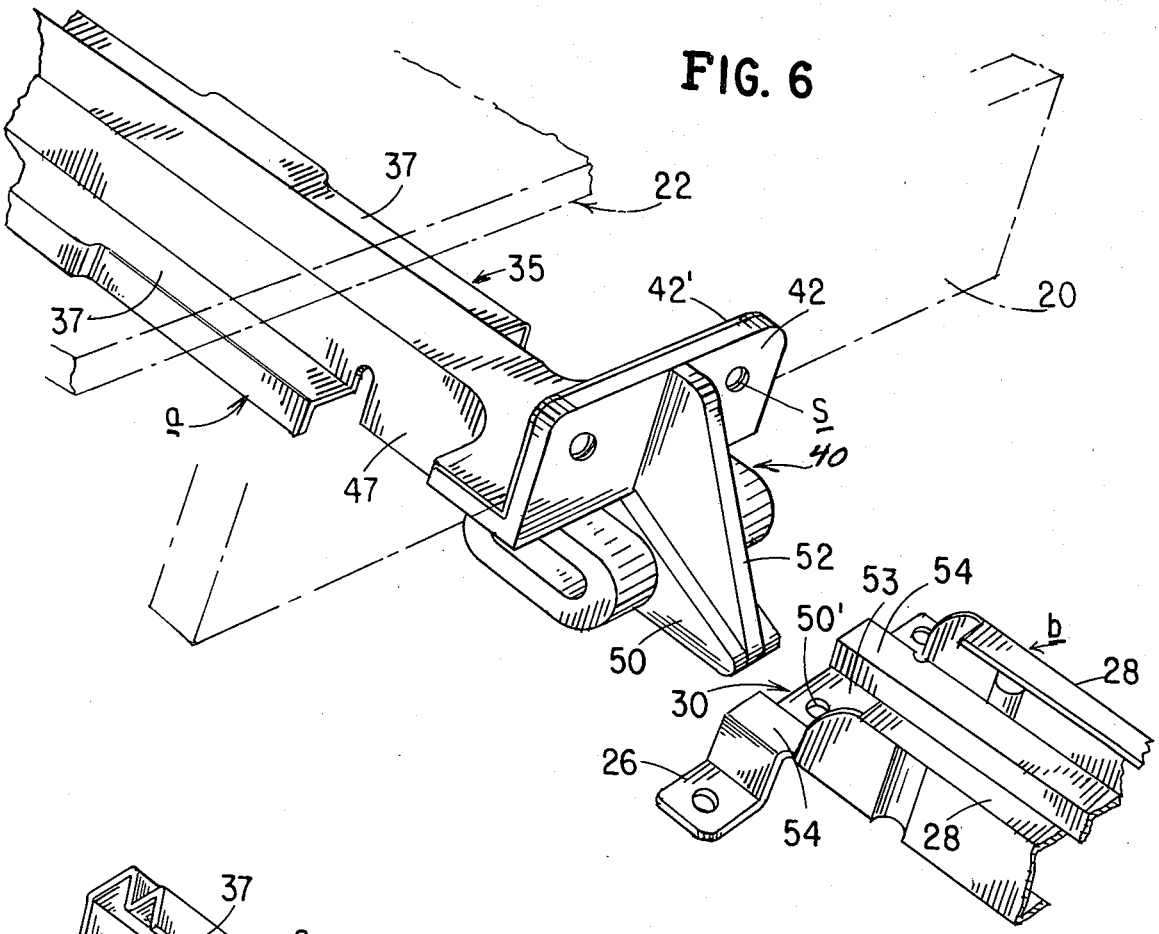
FIG. 6 is a fragmentary top perspective of the exploded slide members.
Figure 4:
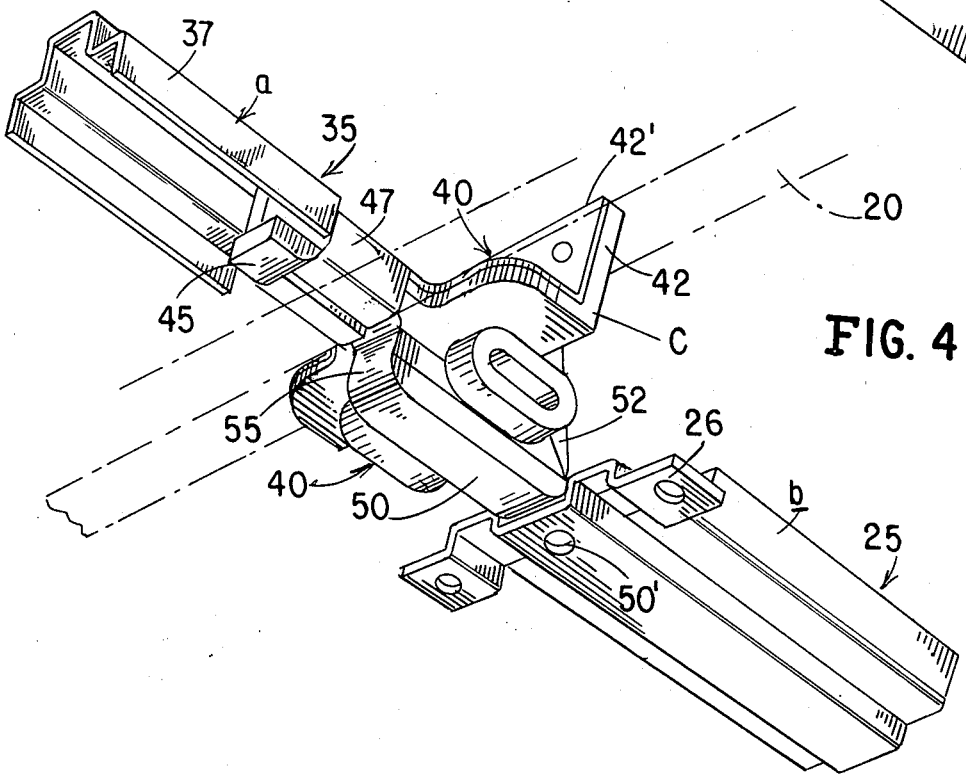
FIG. 4 is a fragmentary perspective view of a drawer slide embodying my invention shown associated with a drawer to which it is mounted, as seen from the underside.

As seen in FIG. 4, block 40 is an integrally molded member having a vertical bar portion 42 perforated to seat screws S for attachment to a vertical plate portion 42' formed on slide a, said plate being attached to the outer face of rear panel 20 of the drawer. (FIGS. 1, 4 and 6.)

Block c also has formed integrally therewith a forwardly extending bar portion 45 designed to seat tightly in a sleeve portion 47 formed integrally with slide member a (FIG. 4). At the opposite end of block 40 is an integral guide portion 50 the front edge of which slopes downwardly to provide a leading entry member 52 to facilitate insertion and interengagement of guide members a and b and thus simplify positioning of the drawer within the cavity. (FIG. 6.)

Portion 50 of the glide block slides with minimum clearance within track 53 of the female slide b while the load is carried on both sides of the glide block portion 40, riding on surfaces 54 of female slide b.

It may be desirable, though not required for full enjoyment of my invention, to provide suitable detent means coacting between the respective channel members a and b. Such detents may take a wide variety of forms, as would be apparent to anyone ordinarily skilled in the art. For example, I may provide mating protuberances struck out from the respective channel members adjacent the respective ends thereof, or at any other expedient point along their length, which bumps or protuberances would, in normal use of the drawer, override each other so that, after the drawer has been inserted in its cavity, a stop is provided to prevent accidental escape of the drawer from its seat. However, the bumps may be so proportioned that, with application of slight additional force, the detents may override each other to permit withdrawal of the drawer when desired.

On female slide b plastic mounting blocks may be used in front and rear instead of the steel mounting pads 26. Also, at the front, plastic friction pads or pressure-sensitive plastic tape might be used to eliminate metal-to-metal contact.

Figure 7:
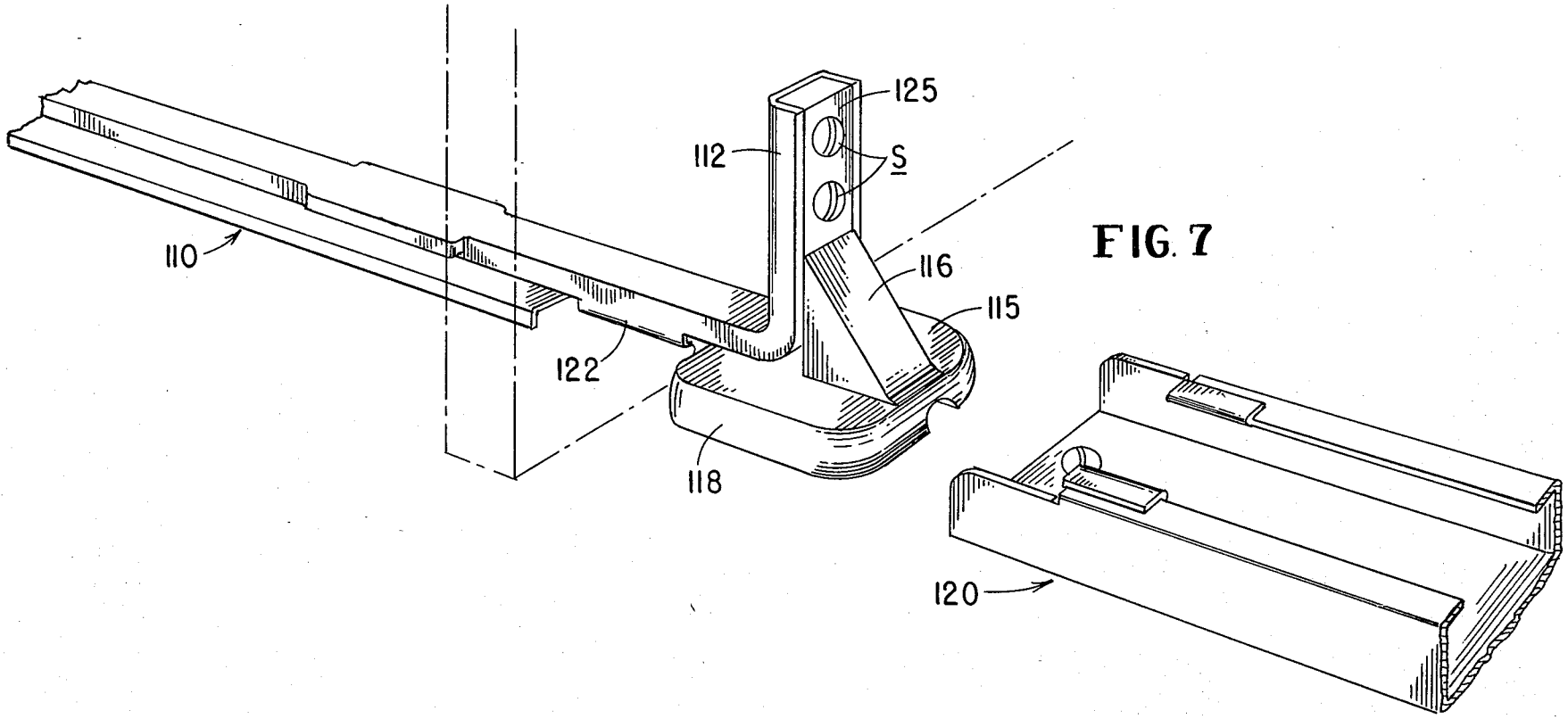
FIG. 7 is a fragmentary exploded top perspective view of a modified form of male and female slide members dissociated from the case with which they are normally assembled.

FIG. 7 shows another embodiment of my invention as applied to another kind of case, such as one with relatively shallow drawers, which for convenience I refer to as a "low boy" version, utilizing the same principle as the embodiment previously described, particularly in that it includes a guide/slide block at the end of male slide 110 for facilitating entry of this slide member into and its movement through the female slide element.

Both slide members 110 and 120 may be metal stampings of generally channel formation, designed and proportioned so that male member 110 may seat and slide snugly within female member 120.

The rear end of member 110 is bent upwardly as at 112 and apertured to receive screws S to secure glide/-slide block 115 which may conveniently be molded in one piece, as in the former embodiment. Block 115 also has a forwardly extending tongue portion 116 with a free sloping face serving as an entry member, to facilitate introduction of slide member 110 into member 120.

Base portion of block 115 has an integral plate portion (not seen) seating in sleeve portion 122 formed on slide 110 and also an upstanding spertured bar portion 125 seating in upstanding portion 112 of slide 110.

Obviously, tongue member 116 with its forwardly exposed sloping face function, as in the former embodiment, along with base portion 115, to lead the male slide into the female slide and then facilitate its smooth sliding movement therein.

CONCLUSION

Various changes coming within the spirit of my invention may suggest themselves to those skilled in the art. Hence, I do not wish to be limited to the specific forms shown or uses mentioned except to the extent indicated by the appended claims.

I claim:

1. A drawer slide assembly for a cabinet having a cavity and a drawer slidably seated within said cavity, comprising (a) a first channel member, comprised of a bottom web and lateral walls extending upwardly therefrom and terminating in inwardly facing flanges, said member adapted to be fixedly mounted to said cabinet, (b) a second channel member adapted to be affixed to said drawer for nesting and sliding movement within said first channel member, (c) a body of material having minimal frictional resistance and comprising a vertical member adapted to be affixed to the rear wall of the drawer and a horizontal member fixedly retained on the rear end of said second channel member and adjacent to said rear wall, said body including a base portion having the bottom surface thereof adapted for slidable contact with the upper surface of the web of said first channel member, and (d) a centrally disposed sloping bridging member extending from the rearmost point of said base portion to said vertical member to facilitate the insertion of the rear end of said second channel member into the front end of said first channel member.

2. A device as set forth in claim 1, wherein said inwardly facing flanges at the top of said lateral walls are disposed in overlying relation to the lateral edges of said base portion.

3. A device as set forth in claim 2, wherein said bottom web of said first channel member is contoured with a central longitudinal depressed track portion and a pair of elevated track portions on the opposite sides thereof, and said base portion is formed of a central lowered portion with lateral elevated projections on opposite sides thereof adapted to slide along said elevated track portions while said central base portion slides along said lowered central portion of said web.

4. A device as set forth in claim 3, wherein the opposite ends of said first channel member are each provided with fastening wings extending laterally from said elevated track portions for affixation to said cabinet.

5. A device as set forth in claim 4, wherein said inwardly facing flanges at the top of said lateral walls between said fastening wings are disposed in overlying relation to said lateral elevated projections on said base portion.

6. A device as set forth in claim 1 wherein said first and second channel members are formed of sheet metal and said body at the rear end of the latter is of rigid plastic material having a low coefficient of friction.

7. A device as set forth in claim 6, wherein the rear end of said second channel member is formed with a sleeve portion and said body of rigid plastic material is provided with a forwardly extending bar portion adapted to be seated tightly within said sleeve portion.

* * * * *